US007645180B2

(12) United States Patent
DiNardi

(10) Patent No.: US 7,645,180 B2
(45) Date of Patent: Jan. 12, 2010

(54) METHOD FOR FINISHING A WORKPIECE

(75) Inventor: Peter C. DiNardi, Livonia, MI (US)

(73) Assignee: Thielenhaus Microfinish Corporation, Novi, MI (US)

( * ) Notice: Subject to any disclaimer, the term of this patent is extended or adjusted under 35 U.S.C. 154(b) by 0 days.

(21) Appl. No.: 11/975,292

(22) Filed: Oct. 18, 2007

(65) Prior Publication Data

US 2009/0104855 A1 Apr. 23, 2009

(51) Int. Cl.
*B24B 49/00* (2006.01)
*B24B 51/00* (2006.01)

(52) U.S. Cl. ..... 451/5; 451/9; 451/10

(58) Field of Classification Search ..... 451/5, 451/8, 9, 10, 11
See application file for complete search history.

(56) References Cited

U.S. PATENT DOCUMENTS 5,245,793 A 9/1993 Schmitz
5,448,146 A * 9/1995 Erlbacher ..... 318/568.17
5,711,697 A 1/1998 Taninaga et al.
5,718,617 A * 2/1998 Priestley et al. ..... 451/14
6,205,371 B1 * 3/2001 Wolter-Doll ..... 700/174
6,443,818 B1 9/2002 Bent
6,702,649 B2 * 3/2004 Basler ..... 451/9
6,782,760 B2 8/2004 Goldau et al.
6,852,005 B2 2/2005 Goldau et al.
7,118,446 B2 * 10/2006 Walsh et al. ..... 451/5
7,151,977 B2 * 12/2006 Laquerbe ..... 700/174
2003/0096559 A1 * 5/2003 Marshall ..... 451/8
2005/0194185 A1 * 9/2005 Gleitman ..... 175/45
2007/0209445 A1 * 9/2007 Bohr et al. ..... 73/774
2007/0257087 A1 * 11/2007 Klinstein et al. ..... 228/101

* cited by examiner

*Primary Examiner*—Timothy V Eley
(74) *Attorney, Agent, or Firm*—VanOphem & VanOphem, PC

(57) ABSTRACT

A method for abrasive material removal that includes the steps of establishing an optimum force profile relating to the force or contact pressure applied by a processing tool on a workpiece. The actual force generated during the metal removal operation is monitored and compared to the optimum force profile. Based on the comparison of the actual force with the optimum force profile machine parameters are adjusted such that the actual force generated follows the established optimum force profile.

17 Claims, 4 Drawing Sheets

GAGE DISTANCE
STOCK CYCLE LENGTH

METHOD FOR FINISHING A WORKPIECE

CROSS-REFERENCE TO RELATED APPLICATIONS

Not Applicable

FEDERALLY SPONSORED RESEARCH OR DEVELOPMENT

Not Applicable

REFERENCE TO SEQUENCE LISTING

Not Applicable

BACKGROUND OF THE INVENTION

1. Field of the Invention

The present invention relates generally to a method and apparatus for finishing a workpiece. More specifically, the method and apparatus measures or monitors various operating parameters occurring during the finishing operation of a workpiece and varies different operating parameters to maintain optimum predetermined or established values.

2. Description of Related Art

Microfinishing is a unique process that removes surface defects caused by previous operations to produce a high quality finish. The process involves utilizing an abrasive fed against the workpiece under a low or constant force. As is known, the abrasive determines the rate or duration of the feed. After the abrasive removes the initial roughness and reaches the solid, base material, material removal rate is reduced and the abrasive becomes dull. This completes the geometry portion of the microfinishing process, as the abrasive no longer removes a measurable amount of the workpiece material. Continued application of the abrasive to the workpiece functions to create the required surface finish.

One of the problems associated with a microfinishing process is maintaining the effectiveness of the abrasive such that it removes the initial roughness and reaches the solid, base material of the workpiece. Depending upon the coarseness of the workpiece and the force applied on the abrasive, for example, abrasive particles located on a microfinishing film, the abrasive may fracture thus reducing the overall effectiveness of the abrasive, in this case the microfinishing film. The fracture rate of the abrasive is a function of the amount of speed and pressure put on the abrasive in relation to the surface texture of the workpiece. If the surface texture of the workpiece is coarse and too much pressure is applied to the abrasive, the abrasive will fracture which correspondingly reduces its ability to cut efficiently during the normal microfinishing cycle.

Accordingly, too much pressure causes the abrasive to fracture and too little pressure increases the overall cycle time of the microfinishing process. Typically, in order to reduce the risk of fracturing and maintaining the effectiveness of the abrasive, the microfinishing operation is based on a fixed cycle time of increased duration. In short, the abrasive is fed slowly against the workpiece at a reduced rate to correspondingly reduce or prevent fracturing of the abrasive.

Various methods for finishing a workpiece are known, see for example U.S. Pat. No. 6,782,760, that discloses a method for finishing a workpiece by controlling the feed of the processing tool based on the contact pressure. Specifically, a processing tool attached to a tool spindle advances at a preselected feed rate. A force measuring device measures the contact pressure applied by the processing tool on the workpiece and upon recognition of the initial cut and corresponding initial force, stops the feeding or advancing movement. Upon making initial contact, a controller fixes the rate at which the processing tool advances against the workpiece based on preset or predetermined value. If the measured value of the contact pressure or force is greater than the preset value, advancement of the feeding device used to move the processing tool varies in steps or incrementally. In addition, the initial or nominal force value may be reduced during the finishing process with the feed rate values adjusted by a controller subject to a damping function.

While controlling the feed rate to control the force applied to the processing tool can be very effective in achieving a high quality finish it typically requires starting with a low feed rate and a low force or contact pressure between the processing tool and the workpiece to prevent fracturing of the abrasive on the processing tool due to the condition of the workpiece. This process takes into account the worst-case scenario of the surface texture of the workpiece and builds into the microfinishing operation an increased cycle time to address the worst-case scenario. This equates to a fixed cycle time of somewhat longer duration than is necessary, in that a certain amount of time is used in advancing the processing tool slowly against the workpiece to reduce any undesired premature fracturing of the abrasive particles and consequently reducing their useful life.

From the above, it can be appreciated that a method and apparatus for microfinishing a workpiece that monitors and controls additional variables in the finishing process in addition to the force applied by the processing tool on the workpiece is needed. Such a method could be used to control the processing parameters and thus reduce potential failure or fracturing of the abrasive thereby increasing the useful life of the processing tool and producing a microfinishing apparatus and method that processes the workpiece in the most economical time and efficient manner.

SUMMARY OF THE INVENTION

According to the preferred embodiment of the present invention, the method includes establishing an optimum force profile used during a material removal operation. The actual force generated during the material removal operation is monitored and compared to the established optimum force profile. Based on the comparison of the actual or monitored force with the establish optimum force profile, parameters of the material removal apparatus are adjusted to bring the actual force generated to more closely approach the optimum force profile.

In one embodiment of the invention, the torque of various servomotors used in the material removal apparatus is monitored and compared to a known predetermined value. If the torque of the servomotors exceeds a predetermined level, the torque is reduced to a level at or below the predetermined level to reduce potential loss of processing tool efficiency.

In a further embodiment of the present invention, tool spindle and work spindle speeds are adjusted to maintain the predetermined force profile. In addition, the tool spindle is arranged to swivel about the center of the workpiece resulting in an oscillation motion which improves the rate of stock removal.

Further, areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
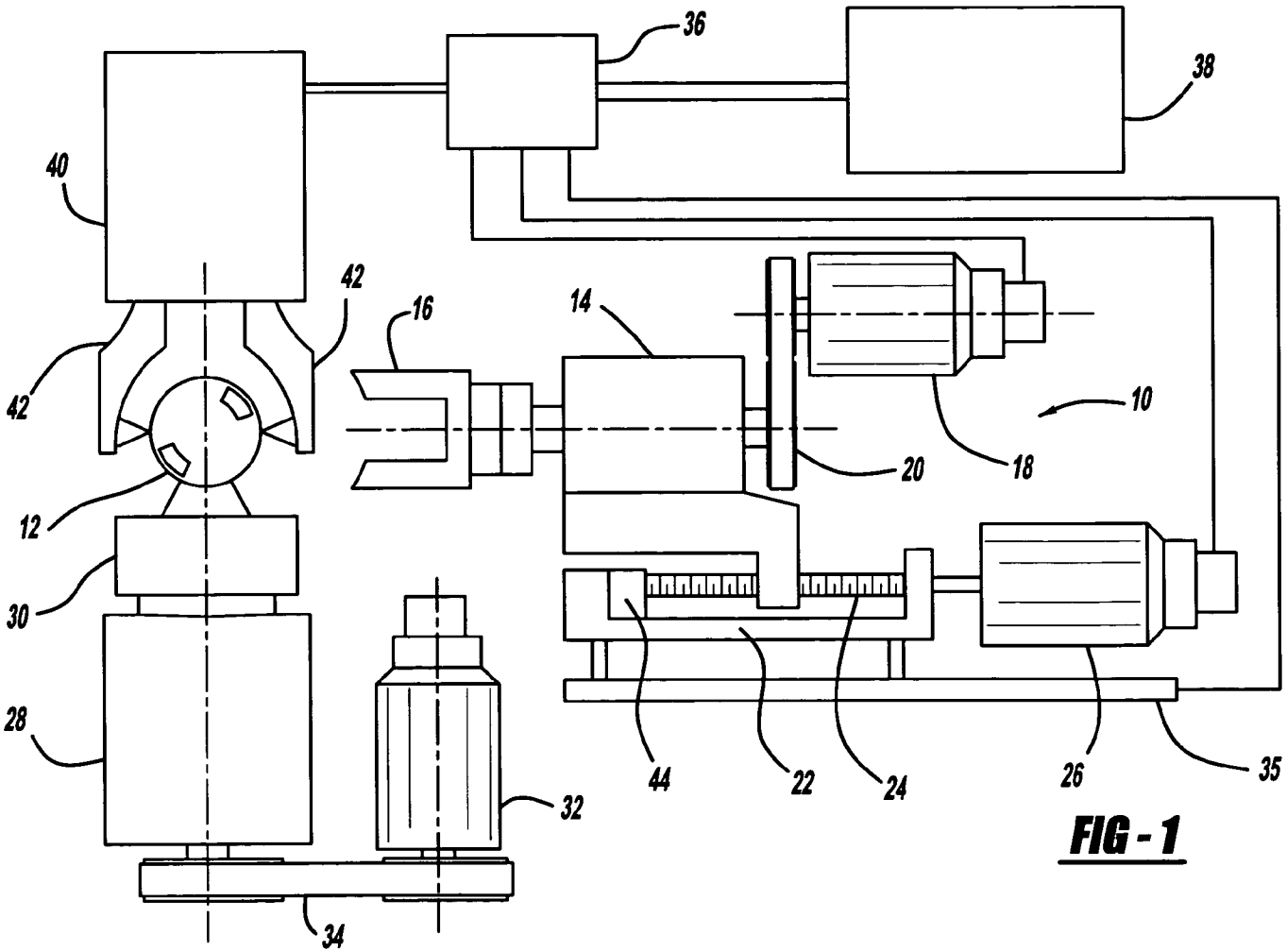
FIG. 1 is a schematic view of a material removal apparatus according to the present invention.

Turning now to FIG. 1, there is shown a microfinishing apparatus, seen generally at 10, for use in finishing a workpiece 12 which could be a ceramic, metal, carbon, graphite, or other material. The microfinishing apparatus 10 includes a tool spindle 14 supporting a processing tool 16 used to finish the workpiece 12. While shown herein as a finishing stone, the processing tool 16 may also include a tape or film having an abrasive material located thereon. A tool spindle servomotor 18 connects to and drives the tool spindle 14 through a pulley and timing belt arrangement 20. The tool spindle 14 is mounted for reciprocal movement on a tool slide 22. As illustrated herein, the tool spindle 14 is mounted on a non-preloaded ball screw 24. A tool slide servomotor 26 connected to the ball screw 24 operates to rotate the ball screw 24 and correspondingly move the tool spindle 14 and processing tool 16 into engagement with the workpiece 12. The tool slide 22 and related pulley and timing belt arrangement 20 is further mounted to a base member 35 to provide a swivel motion to the tool slide 22 through the use of an oscillation servomotor (not shown) so that the complete slide and components may swivel so as to provide an oscillation motion A, along base member 35 with respect to the workpiece 12 as clearly shown in FIG. 2.

The microfinishing apparatus 10 further includes a work spindle 28 including a workpiece support member 30 that supports the workpiece 12 during the microfinishing operation. A work spindle servomotor 32 connects to and drives the work spindle 28 through a drive belt 34. As is known in the microfinishing art, the work spindle 28 operates to move or rotate the workpiece 12 during the microfinishing operation.

The tool spindle servomotor 18, tool slide servomotor 26, work spindle servomotor 32 and oscillation servomotor (not shown) are each connected to a servo control mechanism 36. The servo control mechanism 36 connects to a control unit 38. The control unit 38 functions to drive and monitor the parameters of the various servomotors, 18, 26, 32 and the oscillation servomotor (not shown) during the microfinishing operation. In addition, a user interface such as a personal computer is used to input specific programming and operation logic into the control unit 38 depending upon the particular requirements for finishing the workpiece 12.

A gage assembly 40 including a pair of gage probes 42 is used to monitor the size and shape of the workpiece 12. Input from the gage probes 42 is sent to the control unit 38 that controls operation of the various servomotors 18, 26, 32 and the oscillation servomotor (not shown), in accordance with input feedback received from the gage assembly 40 regarding the size and finish of the workpiece 12.

A force measuring device or sensor 44 located on the tool slide 22 measures the contact force applied by the processing tool 16 against the workpiece 12. The force measuring device 44 may be a load cell or other type of measurement mechanism that monitors the force applied on the workpiece 12 by the tool spindle 14. The force applied to the tool spindle 14 correlates to the force applied on the workpiece 12 by the processing tool 16. As set forth more fully below, the present invention monitors and controls the force applied by the processing tool 16 on the workpiece 12 during the microfinishing operation.

In accordance with the present invention, the processing tool 16 exerts a predetermined and variable pressure or force on the workpiece 12 during the microfinishing operation. Initially, the force on the workpiece 12 is determined from empirical data as different workpieces 12 will require a different initial contact force. At the start of the microfinishing operation, the processing tool 16, containing non-renewable abrasives in either a film or tool (stone) format, is positioned against the workpiece 12 at a predetermined force or contact pressure. With the processing tool 16 in contact with the workpiece 12 at the predetermined pressure, the tool spindle 14 drives the processing tool 16 and the work spindle 28 operates to rotate the workpiece 12. The oscillation servomotor (not shown) is also used to swivel the tool slide 22 relative to the base member 35 so as to create an oscillation by the processing tool 16. Since the processing tool 16 is located against the workpiece 12 at start up, if the workpiece 12 has a rough surface texture, it is possible, based upon the contact pressure applied to the processing tool 16 to cause fracturing of the abrasive and thus reduce the overall effectiveness of the processing tool 16.

In order to reduce the opportunity for such abrasive fracturing, the present invention utilizes the control unit 38 to monitor the amount of starting torque supplied by the tool spindle servomotor 18 to the tool spindle 14 and that supplied by the work spindle servo motor 32 to the work spindle 28 at startup. The control unit 38 compares the starting torque of both the tool spindle servomotor 18 and the work spindle servomotor 32 with pre-established limits. When the starting torque exceeds the predetermined or pre-established limits, the control unit 38 reacts to the high starting torque by sending a signal to the tool slide servomotor 26 to reduce the initial pressure on the processing tool 16. Reducing the initial pressure on the processing tool 16 reduces fracturing of the abrasive on the processing tool 16 when the workpiece 12 has an unexpected coarse or rough surface texture.

As set forth above, the starting torque of the work spindle 28 corresponding to the oscillation of the workpiece 12 is also measured. Once again, the torque generated by the work spindle servomotor 32 is monitored and compared to predetermined or pre-established limits. In some instances, it may be desirable to reduce the speed of rotation and correspondingly the torque generated by the work spindle 28 rather than reduce the force or contact pressure applied by the processing tool 16 on the workpiece 12. Accordingly, the present invention contemplates controlling the torque generated by the tool spindle servomotor 18 and that generated by the workpiece spindle servomotor 32 so as to enable adjusting the force or contact pressure applied by the processing tool 16 against the workpiece 12.

Thus, the present invention contemplates reading or obtaining feedback information pertaining to the torque of the tool spindle servomotor 18, comparing it to preset limits and adjusting the torque as necessary, including reducing the force or contact pressure applied by the processing tool 16. In addition, the invention also contemplates reading or obtaining feedback information pertaining to the torque of the work spindle servomotor 32 and adjusting the torque of the work spindle servomotor 32. Monitoring and adjusting the torque output of the respective tool spindle servomotor 18 and work spindle servomotor 32 in response to variable workpiece 12 surface textures will reduce potential fracture of the abrasive and help maintain a uniform abrasive life cycle. Reacting to the starting torque in this manner creates a cycle based on incoming surface texture conditions rather than a range of conditions. As opposed to starting with a reduced starting pressure and slowly controlling or increasing the pressure to maintain a desired torque which would increase the overall cycle time.

In addition to monitoring the starting torque and adjusting the initial parameters based thereon, the present invention also contemplates controlling the force or contact pressure on the workpiece 12 during and at the end of the microfinishing cycle or operation. In accordance with known microfinishing processes, the processing tool 16 is advanced against the workpiece 12 at a constant force or contact pressure by varying the feed rate to maintain the force. Once the initial cutting operation is completed, finishing operation continues until at the end thereof the force on the workpiece 12 is gradually reduced until it reaches zero. One method is to stop the tool slide 22 whereby the processing tool 16 remains stationary, by maintaining the processing tool 16 in a stationary position continued operation of the processing tool 16 will gradually reduce the force or contact pressure.

Figure 2:
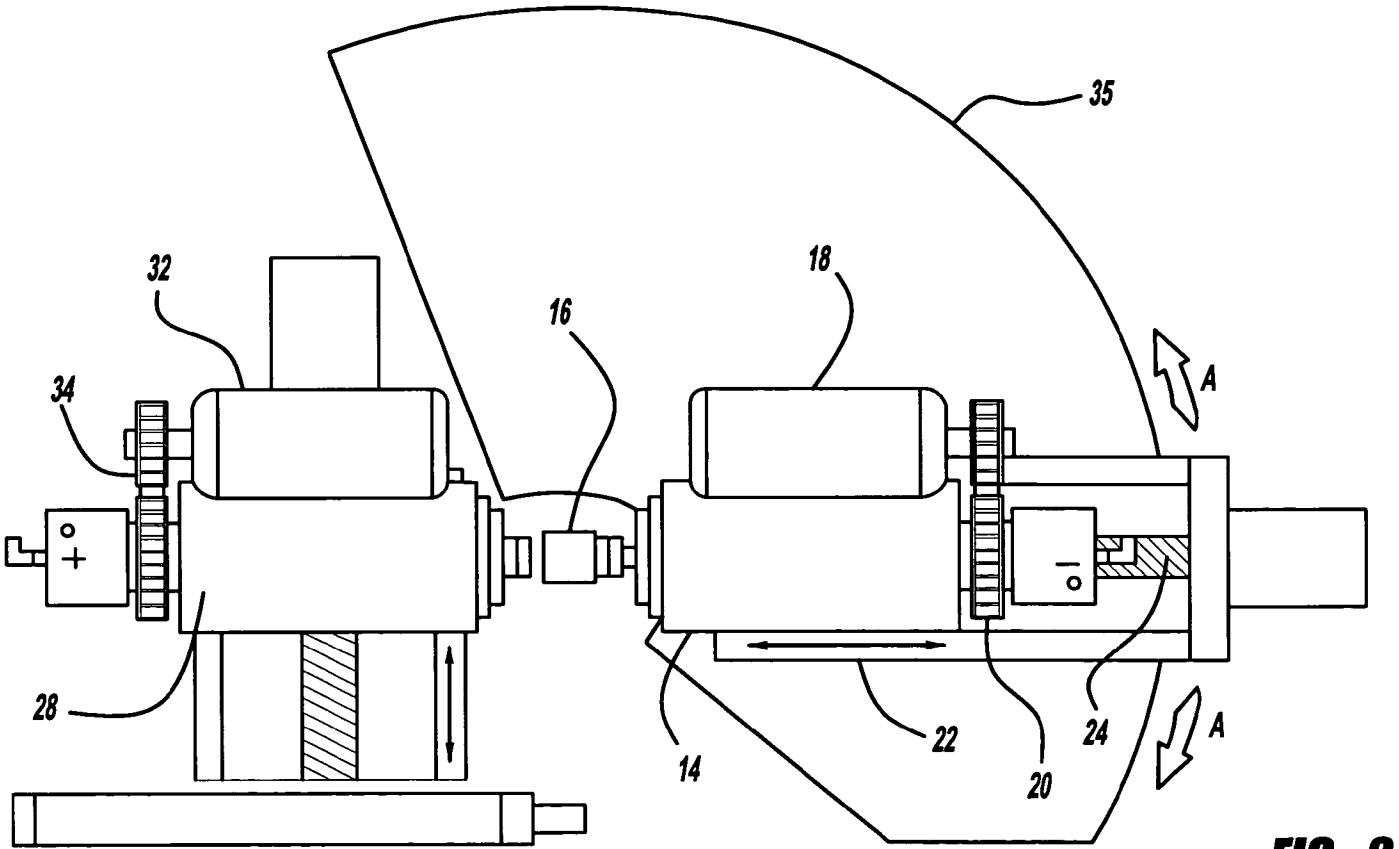
FIG. 2 is a top view of a material removal apparatus of the invention, specifically showing the base member along which the oscillation motion takes place.
Figure 3:
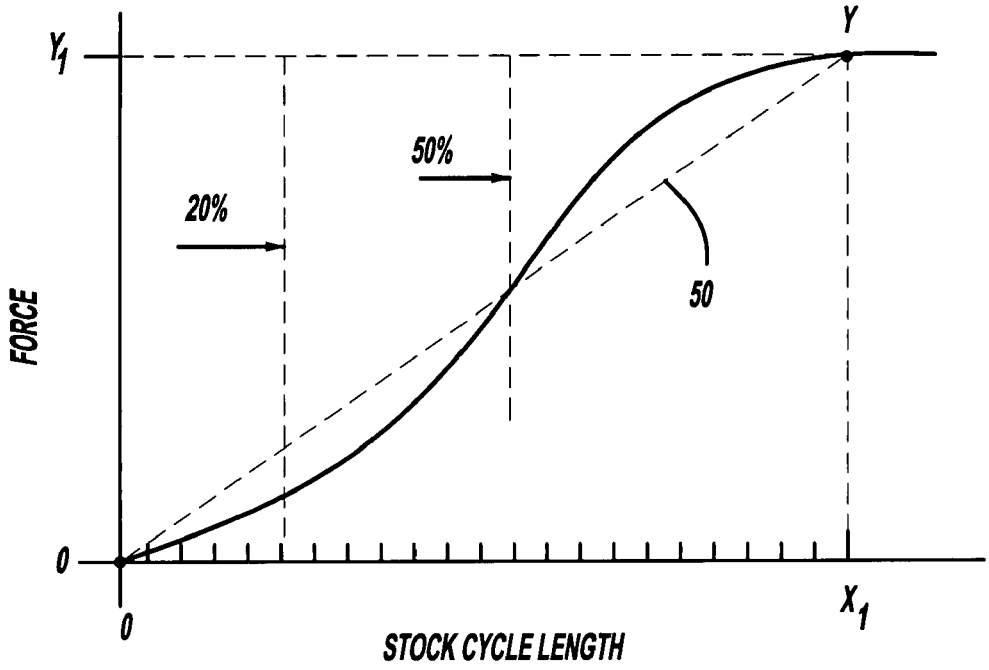
FIG. 3 is a stock cycle length/force diagram illustrating the changes in the force profile or curve based on the position along the stock cycle or length in accordance with the present invention.

Turning to FIG. 2, there is shown another aspect of the present invention wherein the force or contact pressure applied by the processing tool 16 against the workpiece 12 is controlled throughout and to the end of the microfinishing cycle. As illustrated in FIG. 3, the Y-coordinate represents the force or contact pressure applied by the processing tool 16 during the microfinishing operation, with $Y_I$ being the initial force, converted to a 0-1 factor, set at the control unit 38 and applied during the microfinishing operation. The X-coordinate, also converted to a 0-1 factor, represents the microfinishing cycle length, which can be defined in several ways such as gage distance, time or distance traveled by the tool slide 22. The force (Y) is determined based on the X-coordinate, that is, the force (Y) is the force or contact pressure for a particular X-coordinate.

The dotted line 50 in FIG. 2 represents a linear force to microfinishing cycle length when the feed rate is gradually slowed. For example, as the feed rate slows, the force (Y) gradually decreases or reduces in a linear manner as illustrated by the dotted line 50. It is desirable, however, to vary the force (y) in a non-linear manner according to various factors such as gage points, time or distance traveled by the tool spindle 14 and correspondingly the processing tool 16.

Accordingly, the present invention utilizes a nonlinear force curve or path while maintaining a certain feed profile. The force curve illustrated in FIG. 3 is calculated according to the following formula:

$$Y = \frac{(1 - \cos(180\, x^{\alpha}))}{2}$$

Y=the force applied by the processing tool;

X=is the position along the X-coordinate; and $\alpha$=a predetermined value used to increase or decrease the force curve relative to the standard or linear force based on feed rate.

Accordingly, depending upon the workpiece 12, a particular force profile or curve can be developed which results in optimum finishing.

Accordingly, the present invention allows for an optimum force profile while maintaining an established feed rate to reduce processing time. The present invention contemplates maintaining the actual force profile by varying the tool spindle 14 speed and the work spindle 28 speed. For example, if the measured force; i.e., the output of the force sensor 44, falls below the optimum force profile or curve, the tool spindle 14 speed can be decreased and the work spindle 28 speed held constant, increased or decreased depending upon the amount of adjustment needed to increase the overall force and bring the measured actual force up to the optimum force profile or curve. If, however, the measured actual force is greater than the optimum force profile or curve, the tool spindle 14 speed can be increased and the work spindle 28 speed held constant, increased or decreased depending upon the amount of adjustment needed to decrease the measured force. Typically, an increase in tool spindle 14 speed will decrease the force, while an increase in work spindle 28 speed will increase the force. Accordingly, to decrease the overall actual force it is desirable to increase the tool spindle 14 speed and decrease the work spindle 28 speed. Conversely, to increase the overall actual force it is desirable to decrease the tool spindle 14 speed and increase the work spindle 28 speed. Thus, adjustments to the tool spindle 14 speed and the work spindle 28 speed enable the controller to attempt to follow within limits of the optimum predetermined force profile used in connection with microfinishing a workpiece 12.

Figure 4:
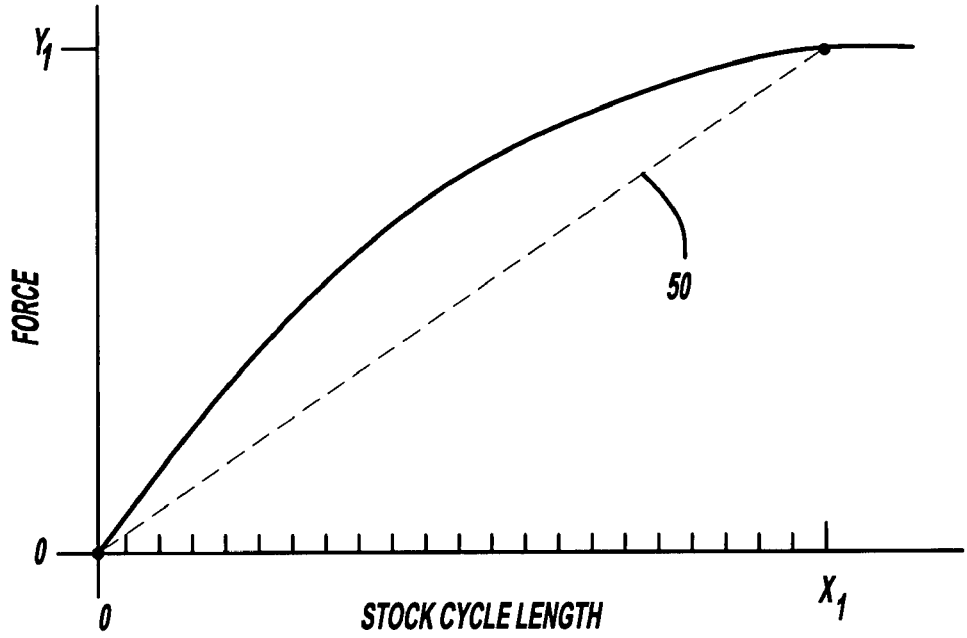
FIG. 4 is a stock cycle length/force diagram illustrating an alternative embodiment of a force profile or curve according to the present invention.
Figure 5:
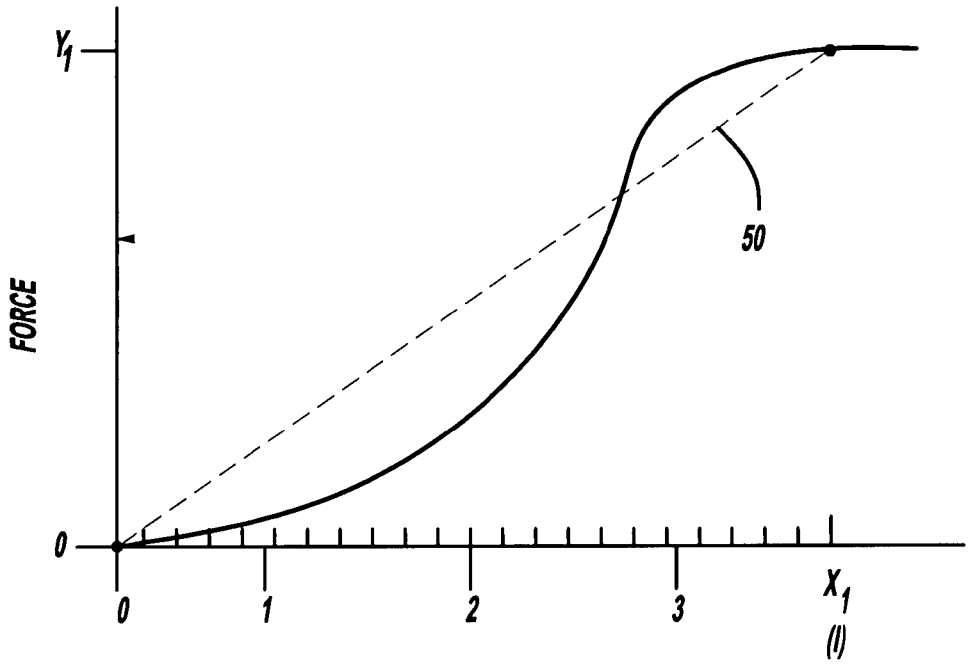
FIG. 5 is a stock cycle length/force diagram illustrating a further embodiment of a force profile or curve according to the present invention.

FIGS. 4-5 illustrate various force profiles developed based on the selection of the exponent $\alpha$. For example, FIG. 3 illustrates a force profile using 1 as exponent $\alpha$, while FIG. 4 illustrates a force profile using for the exponent $\alpha$, a value less than 1 and FIG. 5 illustrates a force profile using for the $\alpha$ exponent a value greater than 1.

As set forth above, the X-coordinate can be set based on a variety of factors. For example, using the gage assembly 40 illustrated in FIG. 1, the force profile changes or varies relative to various gage positions. As illustrated in FIG. 5, the force profile reduces from gage point X ultimately to zero as the gage reaches zero, which represents the preset size of the finished workpiece 12. As set forth above, the force profile can be based on time/length of the finishing operation or cycle, or the distance traveled by the processing tool 16.

Accordingly, the present invention provides the control unit 38 with the ability to determine a predefined force profile whereby the control unit 38 monitors the force applied to the workpiece 12 throughout the entire process. Because it is the force that is being monitored, the processing time may vary for each part, rather than going through a preset or predetermined finishing cycle based on time or feed amount.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of avoiding abrading tool fracture and maximizing abrading tool life in a machining operation, which is caused by the coarseness of the surface of a workpiece significantly reducing the effectiveness of the abrading tool when the abrading tool is first applied to a new workpiece surface, said method comprising the steps of:

establishing a predetermined optimum force profile as a function of the surface finish of an incoming new workpiece;

monitoring the startup torque of a tool spindle servomotor having a processing tool mounted therein, and the startup torque of a work spindle servomotor of said machining operation using a control unit;

comparing each said monitored startup torque generated by said tool spindle servomotor and said work spindle servomotor with a pre-established torque limit;

reducing said startup torque generated by one of said tool spindle servomotor and said work spindle servomotor by adjusting at least one of said tool spindle servomotor and said work spindle servomotor when said comparing step senses said startup torque above said pre-established torque limit to maintain an operating torque below said pre-established torque limit;

monitoring the actual force applied by said processing tool against said workpiece with a control unit during the material removal operation;

comparing said actual force applied by said processing tool with said established predetermined optimum force profile; and adjusting parameters of said machining operation based on said comparison step of said actual force with said predetermined optimum force profile, to minimize the deviation from said optimum force profile throughout said machining operation whereby abrading tool life is maximized during said machining operation.

2. A method of avoiding abrading tool fracture and maximizing abrading tool life as claimed in claim 1 wherein said pre-established torque limit is calculated based on a given set of parameters.

3. A method of avoiding abrading tool fracture and maximizing abrading tool life as claimed in claim 1 wherein said predetermined optimum force profile is calculated based on an algorithm.

4. A method of avoiding abrading tool fracture and maximizing abrading tool life as claimed in claim 1 wherein said step of monitoring said actual force includes utilizing a force measuring device to monitor said actual force of said tool spindle servomotor and of said work spindle servomotor and compare each said monitored actual force with said predetermined optimum force profile.

5. A method of avoiding abrading tool fracture and maximizing abrading tool life as claimed in claim 1 wherein the step of establishing a predetermined optimum force profile includes the step of using an algorithm to change said predetermined optimum force profile based on a workpiece surface parameter.

6. A method of avoiding abrading tool fracture and maximizing abrading tool life as claimed in claim 1 wherein said establishing a predetermined optimum force profile varies exponentially.

7. A method of avoiding abrading tool fracture and maximizing abrading tool life as claimed in claim 1 wherein said step of adjusting the machine operation parameters further comprises means for varying the speed of said tool spindle servomotor.

8. A method of avoiding abrading tool fracture and maximizing abrading tool life as claimed in claim 1 wherein said step of adjusting said machine operation parameters includes varying the speed of one of said tool spindle servomotor and said work spindle servomotor.

9. A method of avoiding abrading tool fracture and maximizing abrading tool life as claimed in claim 1 wherein said step of establishing a predetermined optimum force profile includes the step of establishing a predetermined optimum force profile as a function of a plurality of particular force gage readings and calculating an average force based on said plurality of particular force gage readings and comparing said actual force versus said average force profile for a said plurality of particular force gage readings.

10. A method of avoiding abrading tool fracture and maximizing abrading tool life as claimed in claim 1 wherein said established predetermined optimum force profile has a complex configuration.

11. In a material removal machining process of the type wherein a workpiece is mounted to a workpiece support member and is held by a work spindle and driven by a work spindle servomotor and wherein a processing tool is mounted to a tool spindle and driven by a tool spindle servomotor, wherein the improvement comprising:

establishing a predetermined optimum force profile as a function of the surface finish of an incoming new workpiece;

monitoring startup torque generated by each of said work spindle servomotor and tool spindle servomotor during startup of said material removal process using a control unit;

comparing said startup torque generated by at least one of said tool spindle servomotor and said work spindle servomotor with a pre-established torque limit;

reducing said startup torque generated by adjusting said at least one of said tool spindle servomotor and work spindle servomotor when said comparing step senses said startup torque above said pre-established torque limit to maintain an operating torque below said pre-established torque limit;

monitoring the actual force applied by said processing tool against said workpiece with a control unit during material removal operation;

comparing said actual force applied by said processing tool with said established predetermined optimum force profile; and adjusting parameters of said machining operation based on said comparing step to minimize deviating from said predetermined optimum force profile throughout said material removal operation.

12. The material removal machining process as claimed in claim 11 wherein said pre-established torque limit is calculated based on a given set of machining operation parameters.

13. The material removal machining process as claimed in claim 12 wherein said machining operation parameters includes processing tool travel.

14. The material removal machining process as claimed in claim 12 wherein said machining operation parameter includes processing time.

15. The material removal machining process as claimed in claim 12 wherein said machining operation parameters includes a gage reading.

16. The material removal machining process as claimed in claim 11 wherein the tool spindle speed and workpiece spindle speed are adjusted to maintain torque values below said pre-established torque limit.

17. The material removal process as claimed in claim 11 wherein the speed of said tool spindle servomotor and the speed of said work spindle servomotor are adjusted to maintain the actual force applied to equal said predetermined optimum force profile throughout said material removal operation.

* * * * *